US006557384B1

(12) United States Patent
Cuesta

(10) Patent No.: US 6,557,384 B1
(45) Date of Patent: May 6, 2003

(54) MULTIFUNCTION PADLOCK

(76) Inventor: Johnny M. Cuesta, 815 Russia Ave., San Francisco, CA (US) 94112

( * ) Notice: Subject to any disclaimer, the term of this patent is extended or adjusted under 35 U.S.C. 154(b) by 230 days.

(21) Appl. No.: 09/709,984

(22) Filed: Nov. 8, 2000

(51) Int. Cl.[7] ..... E05B 73/00

(52) U.S. Cl. ..... 70/14; 70/38 R; 70/337; 70/312

(58) Field of Search ..... 70/14, 18, 19, 70/38 A–38 R, 30, 49, 53, 58, 337, 338, 339

(56) References Cited

U.S. PATENT DOCUMENTS

| | | | | | |
|---|---|---|---|---|---|
| 1,355,387 | A | * | 10/1920 | Cohen | 70/38 R |
| 1,473,353 | A | * | 11/1923 | Miller | 70/38 R |
| 1,477,777 | A | * | 12/1923 | Shek | 70/38 R |
| 2,496,320 | A | * | 2/1950 | Vickers | 70/38 |
| 3,585,823 | A | * | 6/1971 | Nagel | 70/49 |
| 3,703,821 | A | | 11/1972 | Dorey | 70/38 R |
| 3,889,497 | A | | 6/1975 | Tuttle | 70/14 |
| 3,988,031 | A | | 10/1976 | Meyer | 292/153 |
| 4,864,834 | A | | 9/1989 | Waite | 70/14 |
| 4,997,219 | A | | 3/1991 | Carter | 292/153 |
| 5,020,342 | A | | 6/1991 | Doan et al. | 70/14 |
| 5,365,757 | A | | 11/1994 | Primeau | 70/14 |
| 5,505,064 | A | * | 4/1996 | Wang | 70/53 |
| 5,823,025 | A | * | 10/1998 | Phifer | 70/38 R X |
| 5,868,015 | A | | 2/1999 | Eaker | 70/129 |
| 5,881,582 | A | | 3/1999 | Monaco | 70/14 |

* cited by examiner

*Primary Examiner*—Suzanne Dino Barrett

(57) ABSTRACT

A multifunction padlock for providing a single unit lock that has the functions of an ordinary lock in conjunction with a lockout system with multiple staples that can be used as a group or individual access lock. To attain this, the multifunction padlock generally comprises of a housing, a staple unit within the housing, a lockout unit within the housing working in conjunction with the staple unit, a group lockout lever attached to the lockout unit parallel to the main shackle, a shackle unit attached from the holding rod to the keying mechanism parallel to the main shackle, a group lockout lever attached in conjunction with the lockout unit and parallel to the unlocking control rod, a shackle unit attached to the top inner chamber of the housing, and a keying mechanism attached in the inner chamber to the bottom surface of the housing. Each staple unit preferably includes a staple held between a top member and a bottom member with an aperture for attaching conventional locks through, a top member and a bottom member attached to the housing parallel to the staple for guiding the staple in and out of the inner chamber, a first spring attached from the top member to the first peg, a hold link attached from the top member to the staple, and the spacers attached perpendicular to the top and bottom members. The lockout unit is comprised of a button protruding partially out of the front surface of the housing for engaging the lockout mode, a button control rod attached from the bottom member to the button portion residing in the inner chamber, a second spring attached from the bottom member to the button, a stopping member attached to the bottom member, and a first peg attached normal to the staple.

8 Claims, 8 Drawing Sheets

72
74
79
29
25
70
79
24
38
49
52
39
35
50
36
32
60
56
64
37
62
40
38
30
42
20
24
22
72
38
30
32
36
37
64
56
38
52
12
80
62
78
82
26
84

MULTIFUNCTION PADLOCK

BACKGROUND OF THE INVENTION

1. Field of the Invention

The present invention relates generally to locks and more specifically it relates to a multifunction padlock for providing a single unit lock that has the functions of an ordinary lock in conjunction with a lockout system with multiple staples that can be used as a group or individual access lock.

2. Description of the Prior Art

Locks have been in use for years. Typically, conventional locks are utilized for locking entrances or compartments such as gates, doors, cabinets, and safety deposit boxes. Conventional locks are comprised of a shackle with an arced bend in it, a casing usually made of steel, a locking mechanism, and a holding rod which latches the shackle when the keying mechanism is engaged.

The main problem with conventional locks is that the main structure is neither as strong nor secure as the present invention. In addition, in most cases when using multiple locks an individual must hook them up in series. Furthermore, the use of a chain must be used in most cases of securing large objects such as two gateposts with multiple locks. Finally, no device commercially available is capable of being used as a group access lock, individual access lock, or as a lockout system.

Examples of patented locks which are illustrative of such prior art include U.S. Pat. No. 3,703,821 to Dorey; U.S. Pat. No. 5,365,757 to Primeau; U.S. Pat. No. 5,881,582 to Monaco; U.S. Pat. No. D267,698 to Domes; U.S. Pat. No. 3,889,497 to Tuttle; U.S. Pat. No. 4,864,834 to Waite; U.S. Pat. No. 4,997,219 to Carter; U.S. Pat. No. 5,020,342 to Doan et al.; U.S. Pat. No. 5,868,015 to Eaker; U.S. Pat. No. 3,988,031 to Meyer.

While these devices may be suitable for the particular purpose to which they address, they are not as suitable for providing a single unit lock that has the functions of an ordinary lock in conjunction with a lockout system with multiple staples that can be used as a group or individual access lock.

In these respects, the multifunction padlock according to the present invention substantially departs from the conventional concepts and designs of the prior art, and in so doing provides an apparatus primarily developed for the purpose of providing a single unit lock that has the functions of an ordinary lock in conjunction with a lockout system with multiple staples that can be used as a group or individual access lock.

SUMMARY OF THE INVENTION

In view of the foregoing disadvantages inherent in the known types of locks now present in the prior art, the present invention provides a new multifunction padlock construction wherein the same can be utilized for providing a single unit lock that has the functions of an ordinary lock in conjunction with a lockout system with multiple staples that can be used as a group or individual access lock.

The general purpose of the present invention, which will be described subsequently in greater detail, is to provide a new multifunction padlock that has many of the advantages of the locks mentioned heretofore and many novel features that result in a new multifunction padlock which is not anticipated, rendered obvious, suggested, or even implied by any of the prior art locks, either alone or in any combination thereof.

To attain this, the present invention generally comprises of a housing, a plurality of staple units within the housing, a plurality of lockout units within the housing working in conjunction with the plurality of staple units, a group lockout lever attached from the holding rod to the keying mechanism parallel to the main shackle, a shackle unit attached from the holding rod to the keying mechanism parallel to the main shackle, a group lockout lever attached in conjunction with the lockout unit and parallel to the unlocking control rod, a shackle unit attached to the top inner chamber of the housing, and a keying mechanism attached in the inner chamber to the bottom surface of the housing.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a multifunction padlock that will overcome the shortcomings of the prior art devices.

A second object is to provide a multifunction padlock for providing a single unit lock that has the functions of an ordinary lock in conjunction with a lockout system with multiple staples that can be used as a group or individual access lock.

Another object is to provide a multifunction padlock that has multiple staples for attaching conventional locks.

An additional object is to provide a multifunction padlock that is capable as a lockout system with a push of a button.

A further object is to provide a multifunction padlock that is thicker and therefore more sturdy and strong in structure than conventional locks.

Another object is to provide a multifunction padlock that eliminates the use of chains or locks in series with its multiple staple unit.

A further object is to provide a multifunction padlock that allows for individual and group access.

An additional object is to provide a multifunction padlock that has one master key system with multiple padlocks for access by different people with approved access.

Another object is to provide a multifunction padlock that has a hooked main shackle for ease of operation.

Other objects and advantages of the present invention will become obvious to the reader and it is intended that these objects and advantages be within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
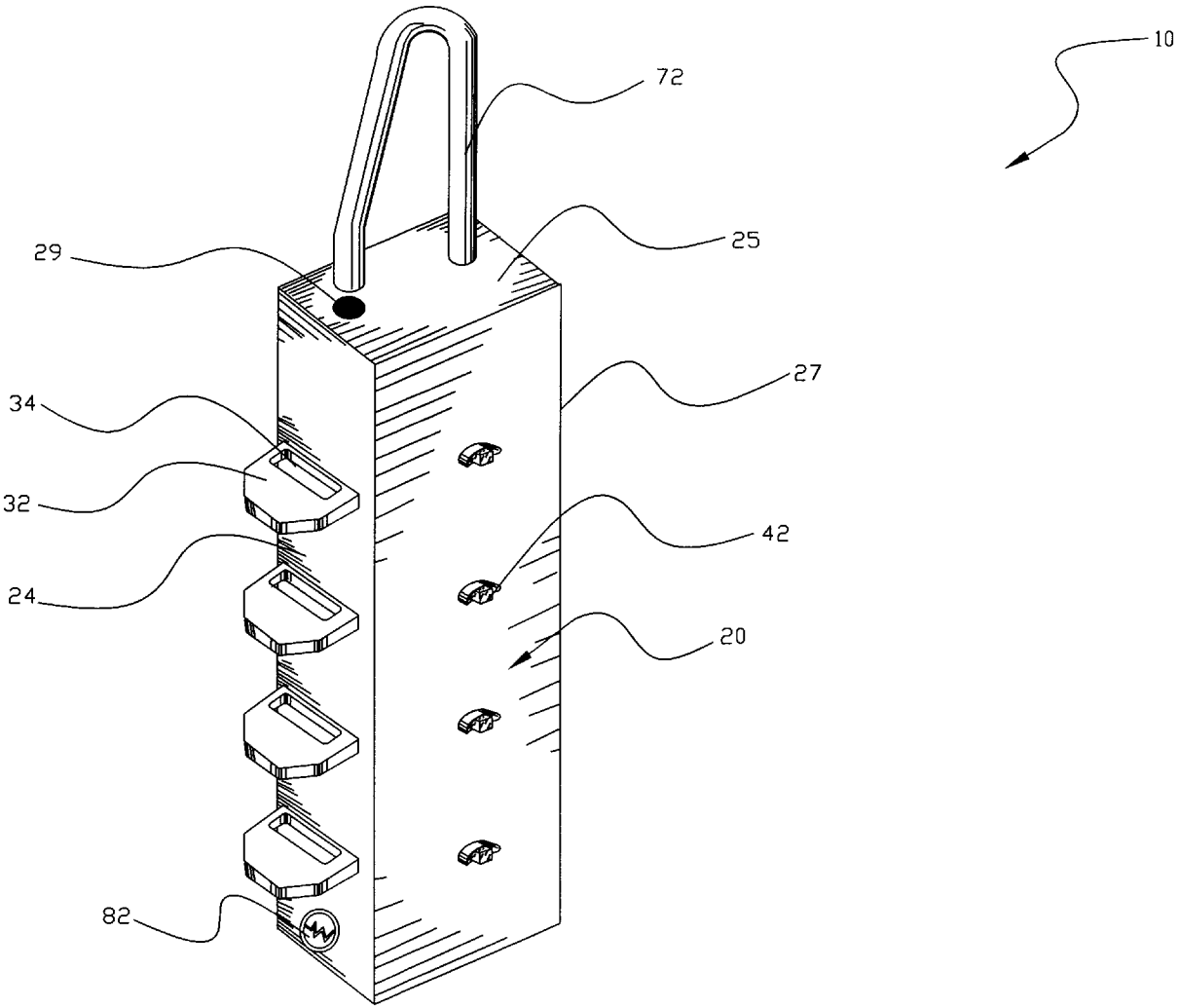
FIG. 1 is an upper perspective view of the present invention.

Turning now descriptively to the drawings, in which similar reference characters denote similar elements throughout the several views, FIGS. 1 through 9 illustrate a multifunction padlock 10, which comprises of a housing 20, a plurality of staple units 30 within the housing 20, a plurality of lockout units 40 within the housing 20 working in conjunction with the plurality of staple units 30, a group lockout lever 60 attached from the holding rod 74 to the keying mechanism 80 parallel to the main shackle 72, a shackle unit 70 attached from the holding rod 74 to the keying mechanism 80 parallel to the main shackle 72, a group lockout lever 60 attached in conjunction with the lockout unit 40 and parallel to the unlocking control rod 50, a shackle unit 70 attached to the top inner chamber 22 of the housing 20, and a keying mechanism 80 attached in the inner chamber 22 to the bottom surface 26 of the housing 20.

As shown in FIGS. 1 through 7 of the drawings, the housing 20 is comprised of a top surface 25, a bottom surface 26, a pair of side surfaces 24, a front surface 27, and a back surface 28 that define an inner chamber 22. As shown in FIG. 1 of the drawings, a first aperture 29 is positioned within the housing 20 to removably receive the main shackle 72. The housing 20 acts as a structural holding cell for the components of the present invention.

Figure 2:
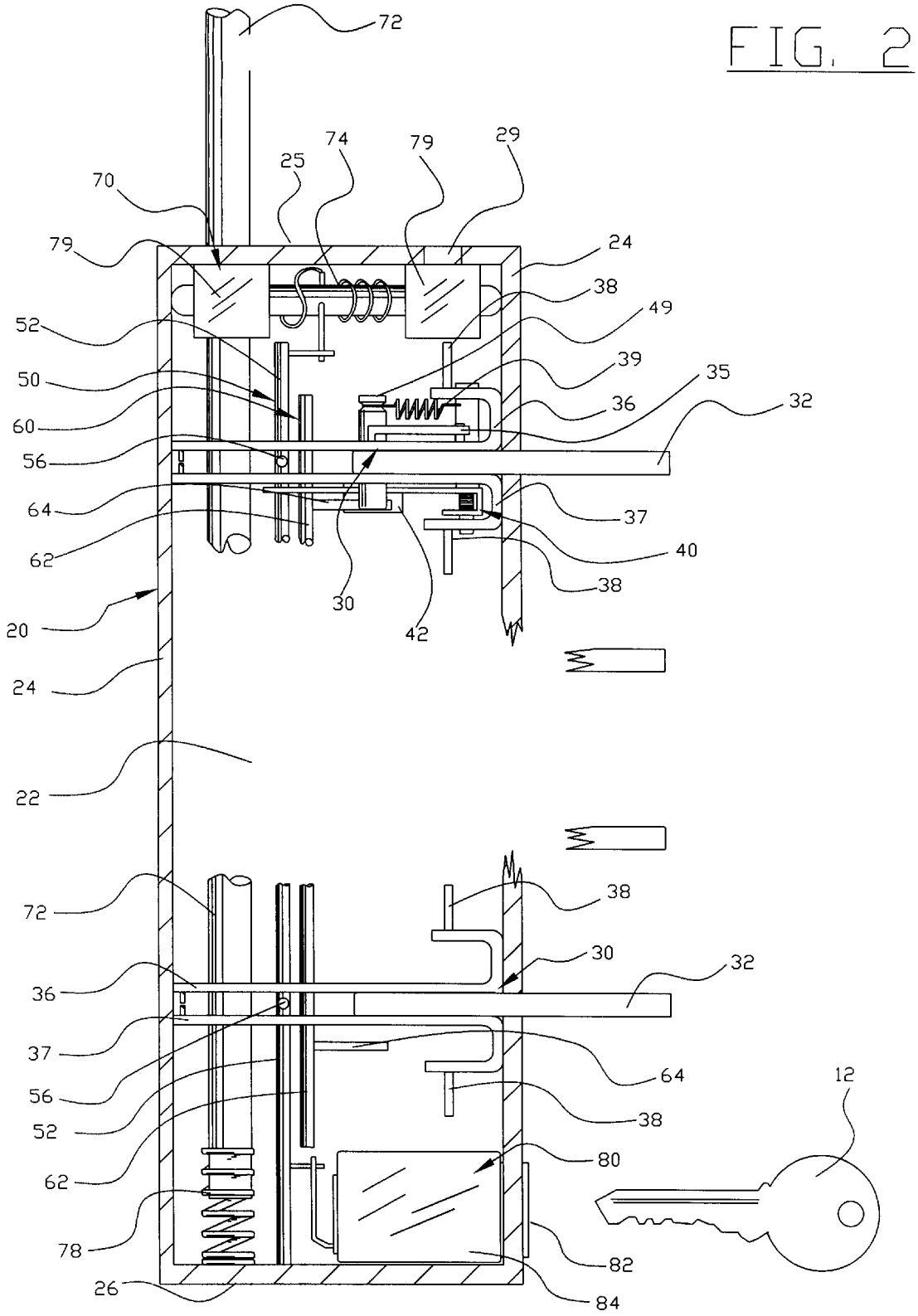
FIG. 2 is a cut away front view of the inner mechanics of the present invention.
Figure 3A:
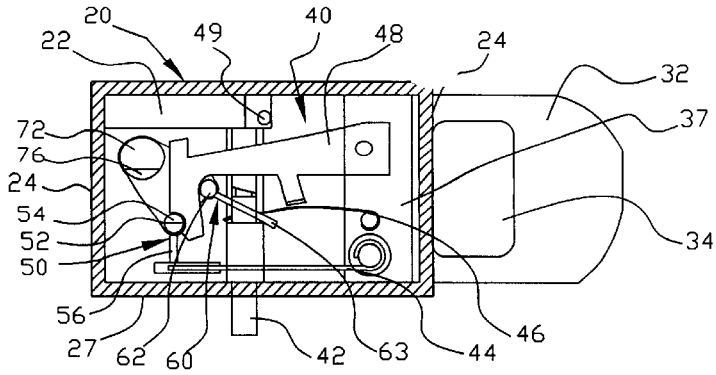
FIG. 3 is a top cut away view of the operation of the lockout unit of the present invention.
Figure 3B:
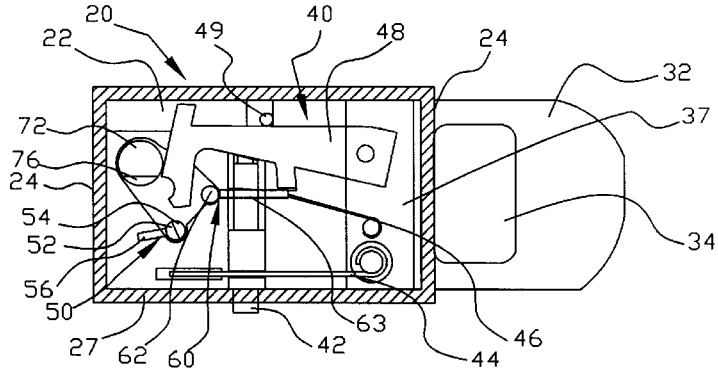
Figure 3C:
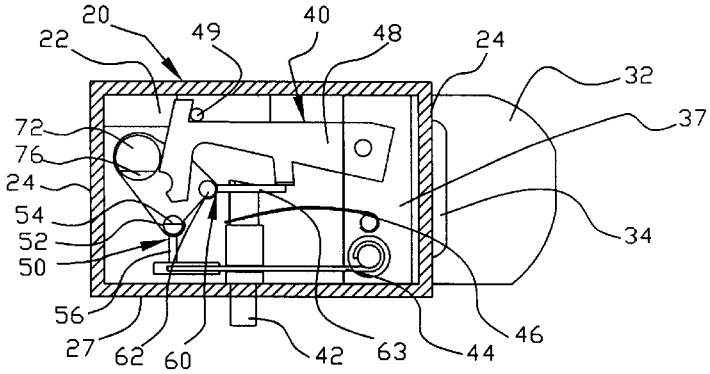
Figure 3D:
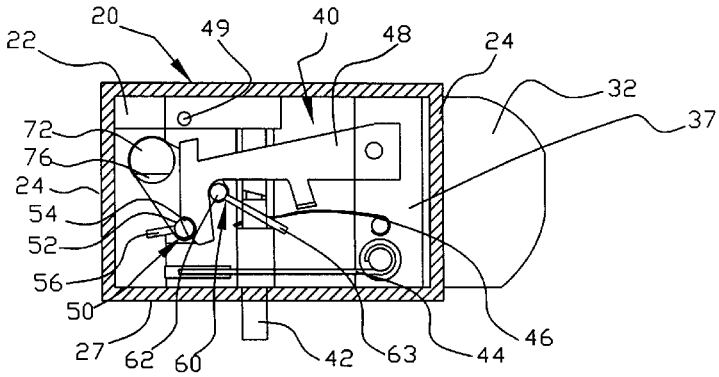
Figure 4A:
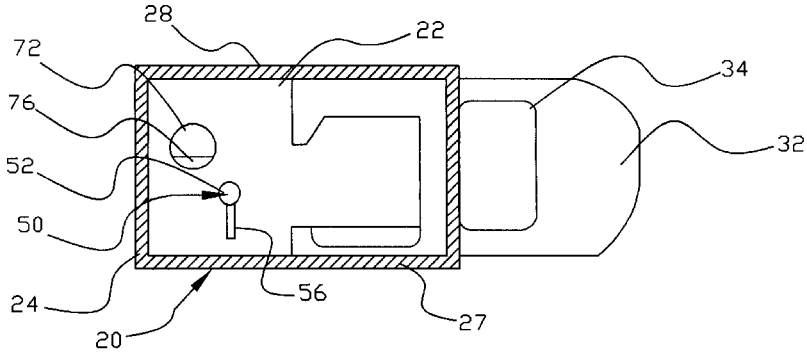
FIG. 4 is a top cut away view of the operation of the staple unit of the present invention.
Figure 4B:
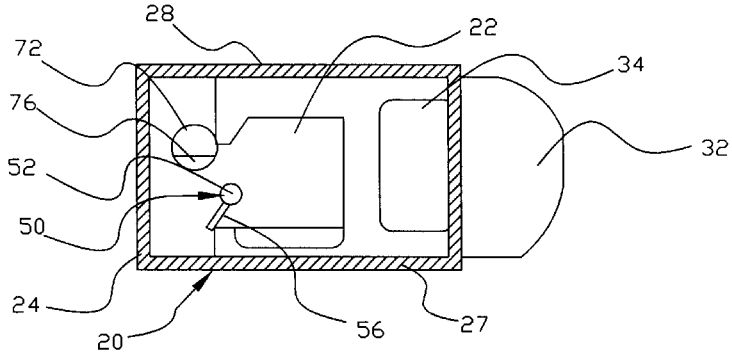
Figure 4C:
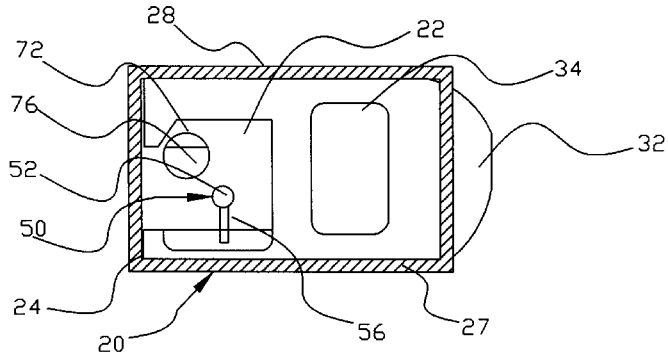
Figure 4D:
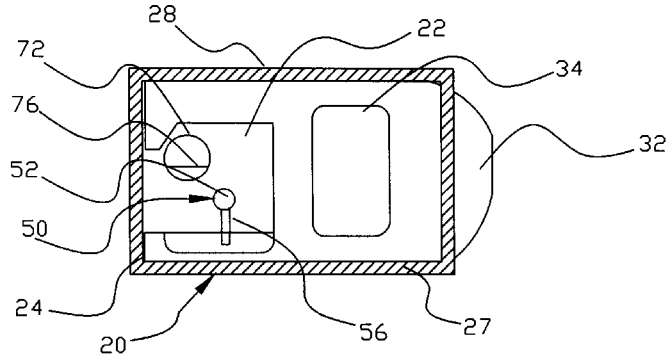
Figure 5:
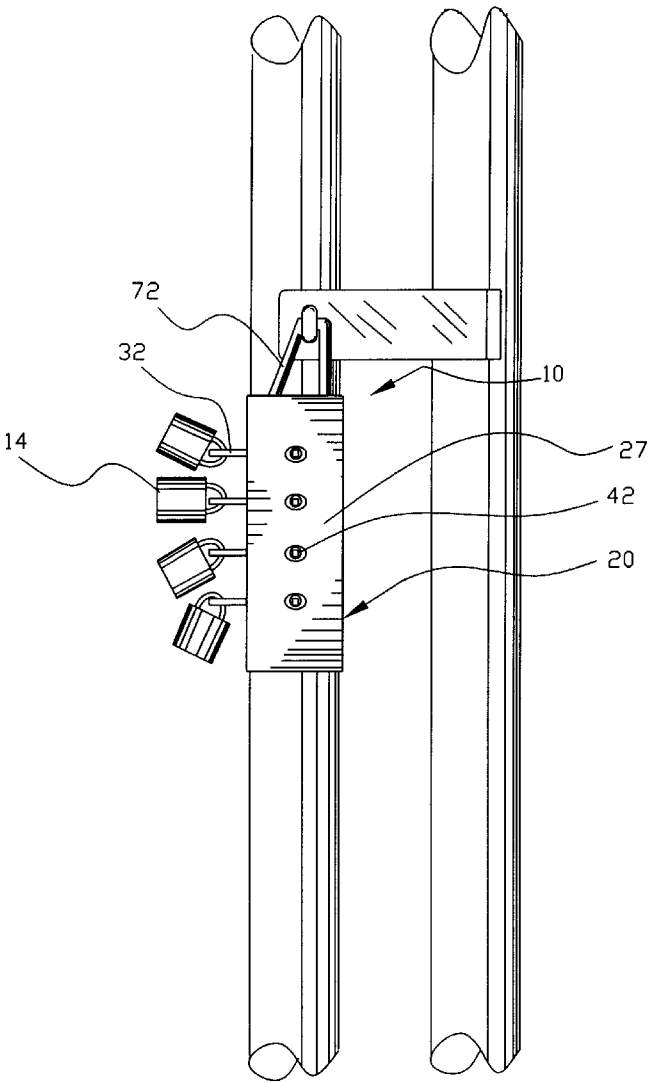
FIG. 5 is a front view of the operation of the present invention.
Figure 6:
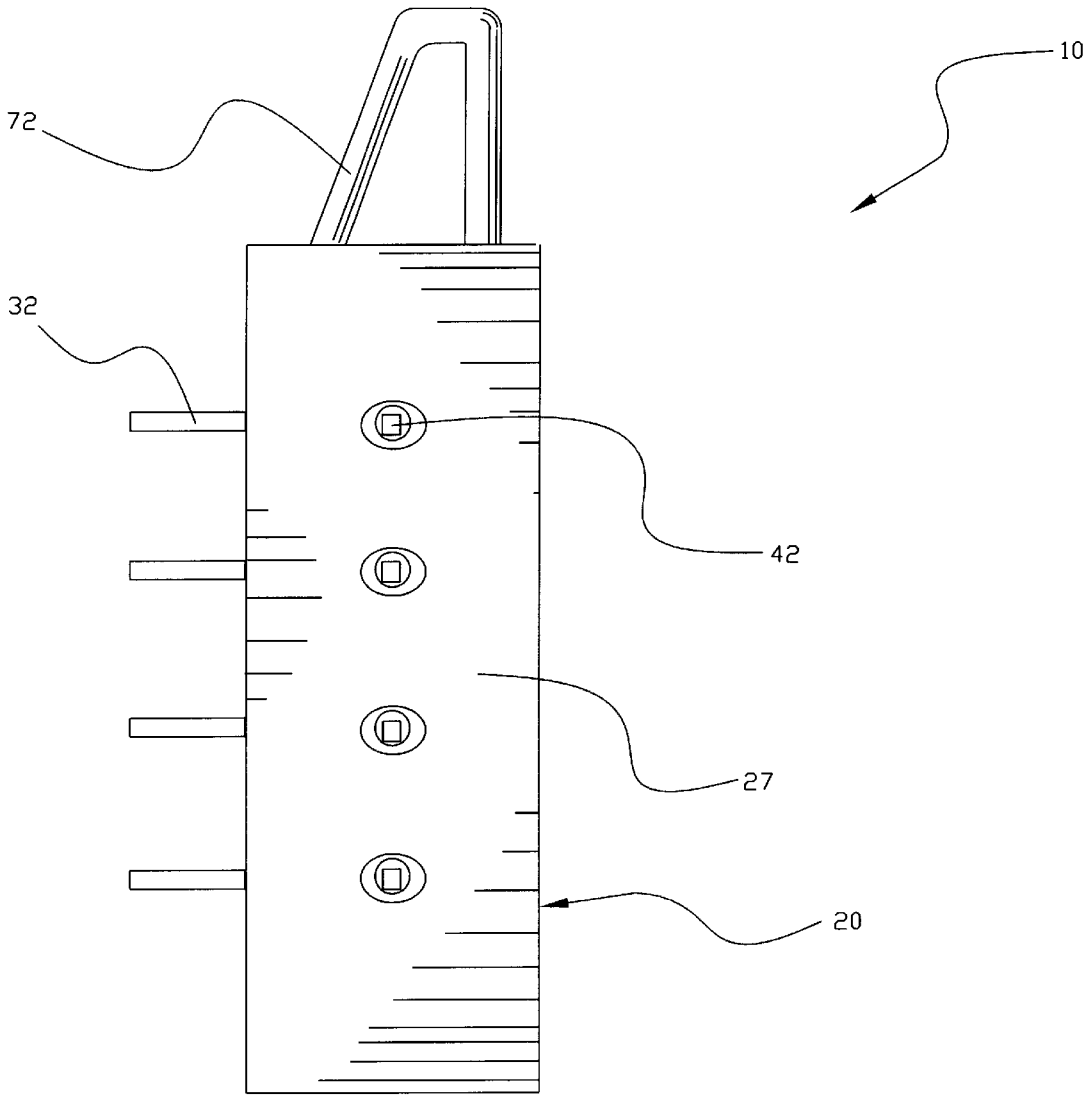
FIG. 6 is a front view of the present invention.
Figure 7:
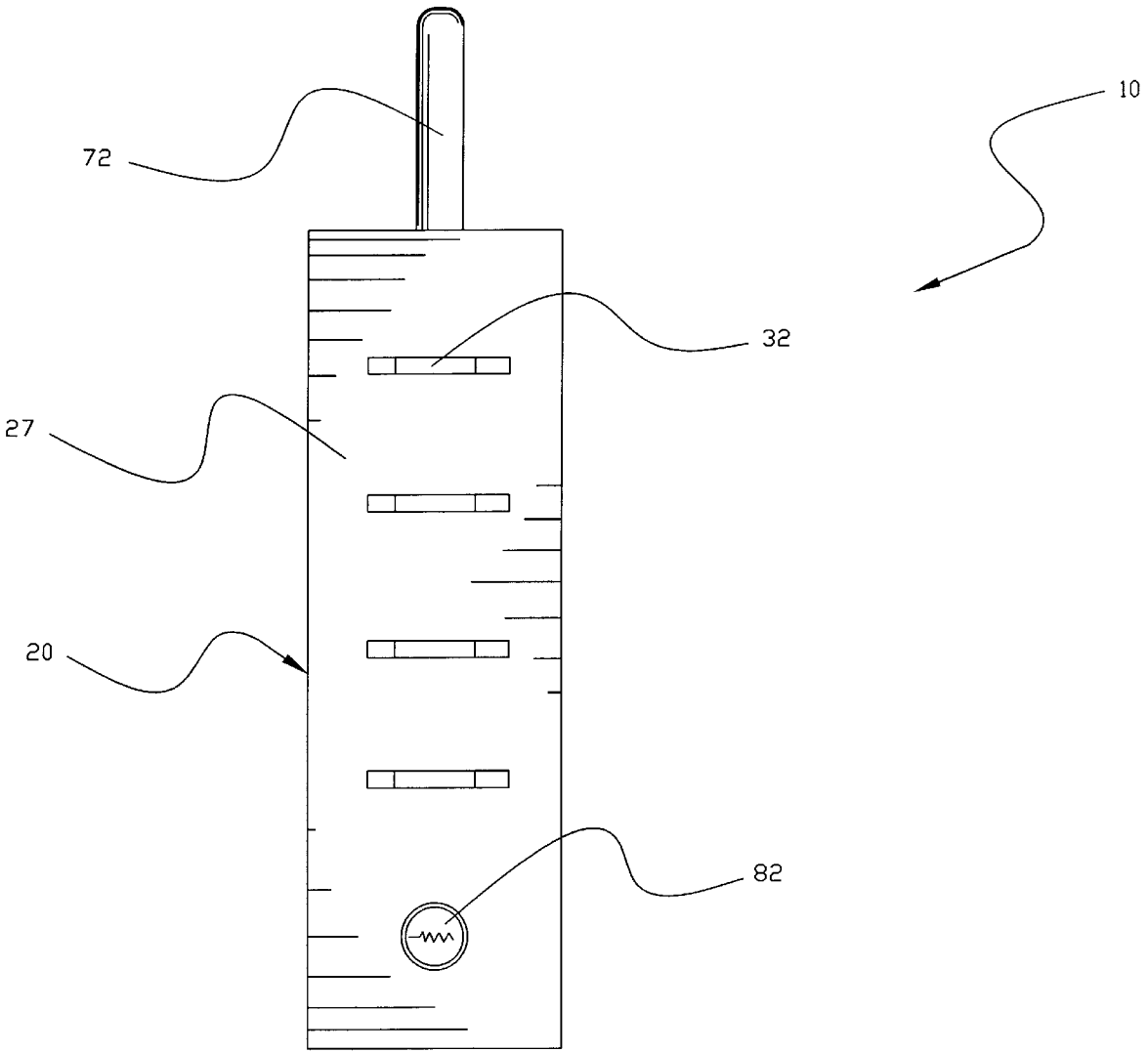
FIG. 7 is a side view of the present invention.

As best shown in FIGS. 3*a–d* and 4*a–d*, each staple unit 30 preferably includes a staple 32 slidably retained between a top member 36 and a bottom member 37. A second aperture 34 is positioned within each staple 32 for receiving conventional locks 14 as best shown in FIG. 1 of the drawings. The top member 36 and the bottom member 37 are attached to the housing 20 parallel to the staple 32 for guiding the staple 32 in and out of the inner chamber 22 as best shown in FIG. 2 of the drawings.

Figure 8:
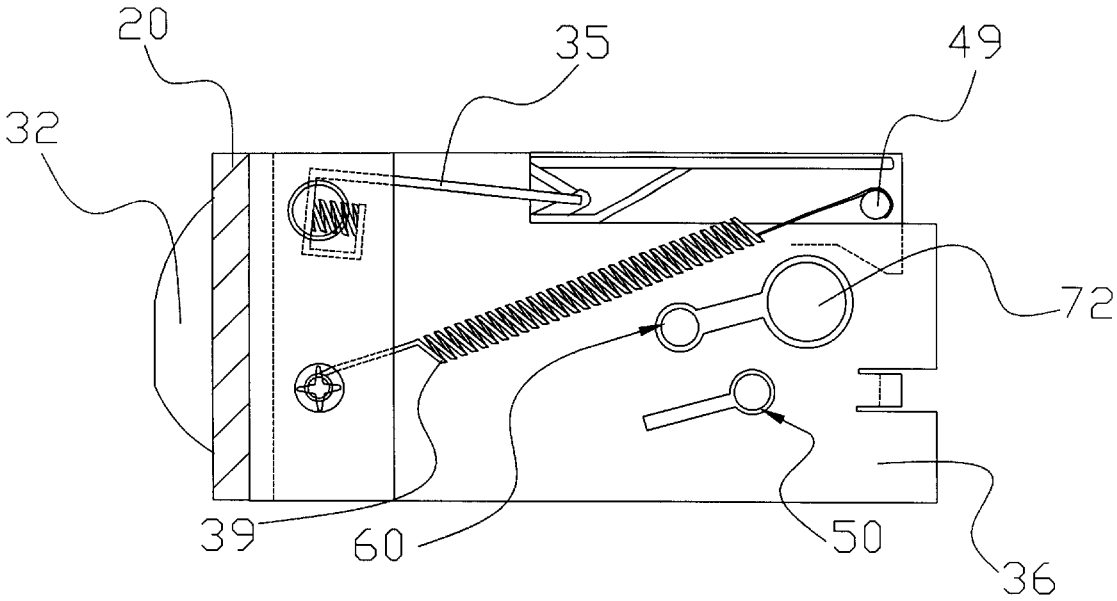
FIG. 8 is a top cutaway view of the staple unit with the top member of the present invention.
Figure 9:
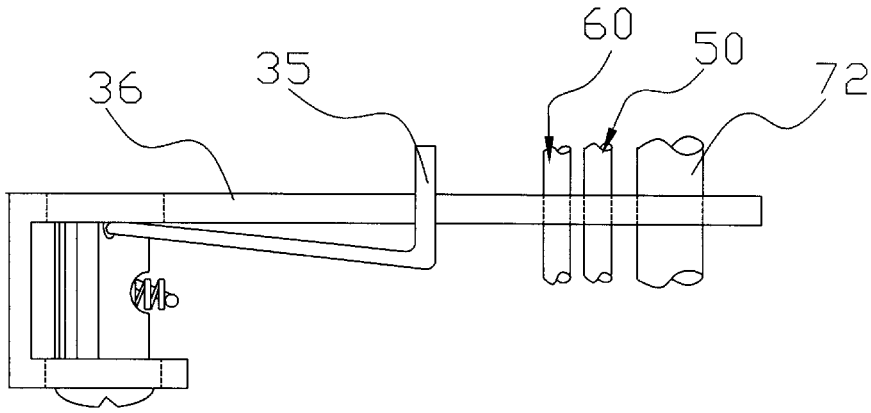
FIG. 9 is a side view of the hold link operation of the present invention.

A hold link 35 attached to the top member 36 for temporarily holding the staple 32 to prevent it from exiting back out of the housing 20 when engaging the staple unit 30 as best shown in FIGS. 8 and 9 of the drawings. A first spring 39 is attached from the top member 36 to a first peg 49 wherein the first peg 49 is attached to the staple 32 that creates tension for allowing the staple 32 to release outside the inner chamber 22 as further shown in FIG. 2 of the drawings. A pair of spacers 38 are positioned perpendicular to the top member 36 and bottom member 37 for stabilizing the staple unit 30.

As best shown in FIG. 3 of the drawings, the lockout unit 40 includes a button 42 protruding partially out of the front surface 27 of the housing 20 for engaging the lockout mode. A button control rod 44 is attached from the bottom member 37 to the button 42 portion residing in the inner chamber 22 which releases the button 42 after the staple 32 is pushed in and makes contact with it. A second spring 46 is attached from the bottom member 37 to the button 42 which retains the button 42 outward when its not positioned inwardly. A stopping member 48 is attached to the bottom member 37, wherein the stopping member 48 pivots when the button 42 is pushed inwardly and released allowing the stopping member 48 to make contact with the staple 32 preventing any of the staple 32 from making contact with the unlocking control rod 50. A first peg 49 is attached perpendicularly to the staple 32 which catches upon the stopping member 48 when the button 42 is pushed inwardly to prevent the staple 32 from making contact with the unlocking control rod 50.

The unlocking control rod 50 rotates when the keying mechanism 80 is engaged allowing the holding rod 74 to release the main shackle 72 as best shown in FIGS. 2, 8, and 3*a–d*. The unlocking control rod 50 is comprised of a first rod 52 which is parallel to the main shackle 72, a second peg 56, one for each staple 32 for making contact with the staple 32 when engaging the staple unit 30 to rotate the unlocking control rod 50, and a plurality of first slots 54 grooved into the side of the unlocking control rod 50 for each staple 32 which allows the stopping member 48 to be released when retaining the master key 12 in the release position.

The group lockout lever 60 is comprised of the second rod 62, which is parallel to the unlocking control rod 50. A plurality of third pegs 64 are attached to each button 42 protruding outwardly from the group lockout lever 60. When the button 42 is depressed the third peg 64 rotates until it makes contact with the stopping member 48 preventing the stopping member 48 from moving. The third peg 64 rotates in conjunction with the second rod 62 thereby causing all third pegs 64 to rotate thereby stopping the corresponding stopping members 48. The group lockout lever 60 thereby causes the lockout unit 40 to be applied to all the staple units 30 at once.

The shackle unit 70 is comprised of a main shackle 72 attached through the bracket 79, a holding rod 74 attached between the brackets 79 and to the unlocking control rod 50, a second slot 76, one for each staple 32 located in the side of the main shackle 72, a third spring 78 pressed onto the bottom of the main shackle 72, and the brackets 79 attached inside the inner chamber 22 to the top surface 25 of the housing 20. The main shackle 72 rotates within the housing 20 and has a hooked end on the outside of the housing 20, which can be pushed into the first aperture 29 and into the shackle unit 70. The holding rod 74 is released from or pushed into the main shackle 72 when the keying mechanism 80 is engaged. The second slots 76 allow the staples 32 to be pushed through the main shackle 72 when its released and rotated halfway around. The third spring 78 allows the main shackle 72 to release upwardly when the keying mechanism is engaged. The brackets 79 are square in structure and support and house the shackle unit 70.

The keying mechanism 80 is comprised of the casing 84 and keyhole. 82. By putting the master key 12 into the keyhole 82, which is within the casing 84 and its opening residing on the side surface 24 of the housing 20, one may lock or unlock the multifunction padlock 10 with clockwise and counterclockwise movements. The casing 84 is square in structure and houses the mechanics of the keying mechanism 80.

As shown in FIGS. 3*a* through 3*d* of the drawings, the operation of the lockout unit 40 can begin when the multifunction padlock 10 is in regular use where the staples 32 are all the way out. At this position the lockout unit 40 cannot be activated. The stopping member 48 is secured in place by the unlocking control rod 50. Activation of the lockout unit 40 may be obtained by using the master key 12, thus the main shackle 72 is released and while holding the master key 12 in the release position, the first slot 54 is exposed, allowing all the stopping members 48 to be freed by pushing the button 42. This motion also moves the group lockout lever 60 and all the stopping members 48 into lockout position. To release the button 42, the staple 32 is pushed in until it makes contact with the button control rod 44 and the stopping member 48. At this point the button control rod 44 releases the button 42. Since, some of the buttons 42 are not released yet, those unreleased buttons 42 will holdup the group lockout lever 60 which will also hold up all the stopping members 48, thereby preventing any of the staples 32 from making contact with the unlock control rod 50. In order to deactivate the lockout unit 40, one must release all the buttons 42 and then the group lockout lever 60 drops down together with the stopping member 48. The staple 32 makes contact with the unlocking control rod 50 and the main shackle 72. At this point, the first slots 54 are exposed to accept the stopping member 48.

As shown in FIGS. 4*a* through 4*d*, 8 and 9 of the drawings, the operation of the staple unit 30 can be started when the multifunction padlock 10 is in ordinary use where the staples 32 are all the way out. By removing any attached conventional locks 14, the staple 32 may be pushed in until part of the staple 32 makes contact with the main shackle 72 and the unlocking control rod 50. At this point the main shackle 72 is unlocked and released. When the staple 32 is not in use, the staple 32 may be pushed all the way in to prevent an unauthorized use and releasing of the main shackle 72. This is accompanied by turning the main shackle 72 180 degrees to expose the second slot 76 thus allowing staple 32 to pass through. At this point, the staple 32 is temporarily held preventing it from existing back by the hold link 35. When the main shackle 72 is turned back 180 degrees the second slot 76 is no longer exposed, therefore the staple 32 is prevented from exiting at all, causing the shackle unit 70 to be inoperable without the use of the master key 12.

In use, the multifunction padlock 10 may be operated like a conventional lock 14 by inserting the master key 12 into the keying mechanism 80 and rotating it clockwise to rotate the unlocking control rod 50 thus pulling back the holding rod 74 freeing the main shackle 72. Once the main shackle 72 is released the third spring 78 decompresses pushing the main shackle 72 outward. At this point the hooked bend of the main shackle 72 may be attached through the latch of the objects to be secured such as an entryway or a compartment. Once this is accomplished the main shackle 72 may be rotated back to its original position and pressed into the first aperture 29.

The operation of the lockout unit 40 can begin when the multifunction padlock 10 is in regular use where the staples 32 are all the way out. At this position the lockout unit 40 cannot be activated. The stopping member 48 is secured in place by the unlocking control rod 50. Activating the lockout unit 40, by using the master key 12, the main shackle 72 is released and while holding the master key 12 in the release position, the first slot 54 is exposed, allowing all the stopping members 48 to be freed by pushing the button 42. This motion also moves the group lockout lever 60 and all the stopping members 48 into lockout position. To release the button 42, the staple 32 is pushed in until it makes contact with the button control rod 44 and the stopping member 48. At this point the button control rod 44 releases the button 42. Since, not all the buttons 42 are released yet, those unreleased buttons 42 will holdup the group lockout lever 60 which will also hold up all the stopping members 48, thereby preventing any of the staples 32 from making contact with the unlocking control rod 50. In order to deactivate the lockout unit 40, one must release all the buttons 42 and then the group lockout lever 60 drops down together with the stopping members 48. The staple 32 makes contact with the unlocking control rod 50 and main shackle 72. At this point, the first slots 54 are exposed to accept the stopping members 48 thus returning the system to its original state.

The operation of the staple unit 30 can also be started when the multifunction padlock 10 is in ordinary use where the staples 32 are all the way out. By removing any conventional locks 14 that may be attached, the staple 32 may be pushed in until part of the staple 32 makes contact with the main shackle 72 and the unlocking control rod 50. At this point the main shackle 72 is unlocked and released. When the staple 32 is not in use, the staple 32 may be pushed all the way in to prevent an unauthorized use and releasing of the main shackle 72. This is accompanied by turning the main shackle 72 180 degrees to expose the second slot 76 thus allowing staple 32 to pass through. At this point, at the top member 36 side of the staple 32 the hold link 35 temporarily holds the staple 32 preventing it from existing back. When the main shackle 72 is turned back 180 degrees the second slot 76 is no longer exposed, therefore the staple 32 is prevented from exiting at all, causing the shackle unit 70 to be inoperable. Another push of the staple 32 will once again release it allowing the second aperture 34 to be exposed to attach conventional locks 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multifunction padlock, comprising:

a housing having an inner chamber;

a main shackle movably positioned within said housing;

an unlocking control rod rotatably positioned within said inner chamber of said housing;

a keying mechanism positioned within said housing and mechanically connected to said unlocking control rod;

a shackle unit positioned within said inner chamber of said housing and mechanically connected between said unlocking control rod and said main shackle;

a plurality of staple units positioned within said housing and mechanically engaging said unlocking control rod for rotating said unlocking control rod thereby allowing the release of said main shackle from said shackle unit.

2. The multifunction padlock of claim 1, including a group lockout lever positioned within said housing and a plurality of buttons positioned within said housing that are mechanically connected to said group lockout lever for positioning each of said plurality of staple units into lockout mode requiring each of said plurality of staple units to be depressed to release said main shackle.

3. The multifunction padlock of claim 1, wherein each of said plurality of staple units is comprised of:

a staple slidably positioned within said housing; and a first aperture positioned within said staple.

4. The multifunction padlock of claim 3, wherein each of said plurality of staple units includes a first spring positioned within said housing and mechanically engaged to said staple for applying an outward force to said staple during operation.

5. The multifunction padlock of claim 4, including a top member and a lower member attached to said housing and slidably receiving said staple.

6. The multifunction padlock of claim 5, wherein said staple engages a corresponding first peg attached to said unlocking control rod for rotating said unlocking control rod.

7. The multifunction padlock of claim 1, wherein said staple engages a corresponding first peg attached to said unlocking control rod for rotating said unlocking control rod.

8. The multifunction padlock of claim 1, wherein said shackle unit is comprised of a first bracket positioned about said main shackle, a holding rod extending from said first bracket and mechanically connected to said unlocking control rod, and a second bracket attached to said holding rod opposite of said first bracket for catchably receiving a distal portion of said main shackle.

* * * * *